US010772400B2

(12) United States Patent
Booth

(10) Patent No.: US 10,772,400 B2
(45) Date of Patent: Sep. 15, 2020

(54) UMBRELLA HOLDER

(71) Applicant: Timothy Booth, Appomattox, VA (US)

(72) Inventor: Timothy Booth, Appomattox, VA (US)

( * ) Notice: Subject to any disclaimer, the term of this patent is extended or adjusted under 35 U.S.C. 154(b) by 0 days.

(21) Appl. No.: 16/364,823

(22) Filed: Mar. 26, 2019

(65) Prior Publication Data

US 2019/0320769 A1 Oct. 24, 2019

Related U.S. Application Data

(60) Provisional application No. 62/659,418, filed on Apr. 18, 2018.

(51) Int. Cl.
*A45B 23/00* (2006.01)

(52) U.S. Cl.
CPC ..... *A45B 23/00* (2013.01); *A45B 2023/0025* (2013.01)

(58) Field of Classification Search
USPC ..... 248/539
See application file for complete search history.

(56) References Cited

U.S. PATENT DOCUMENTS 1,020,846 A * 3/1912 Rauch ..... A01K 97/10 248/514
3,282,482 A * 11/1966 Scharsu ..... A01K 97/10 224/605
3,484,066 A * 12/1969 Aunspaugh ..... A01K 97/10 248/541
5,163,652 A * 11/1992 King ..... A01K 97/10 248/231.61
5,411,237 A * 5/1995 Dougherty ..... A45B 11/00 224/274
5,518,218 A * 5/1996 Leonard ..... A45B 11/00 248/514
5,529,272 A * 6/1996 Baublitz, Sr. ..... B63B 49/00 248/231.71
D396,185 S * 7/1998 Fraser ..... D3/10
5,797,212 A * 8/1998 Kistner ..... A01K 97/10 43/21.2
5,836,327 A 11/1998 Davis
5,857,658 A * 1/1999 Niemiec ..... A01K 97/10 248/231.71
D405,662 S * 2/1999 Evans ..... D8/1
D433,224 S * 11/2000 Cochran, Jr. ..... D3/10
6,435,469 B1 * 8/2002 Ratcliff ..... A45F 5/00 248/213.2
6,898,893 B1 * 5/2005 Mukdaprakorn ..... A01K 97/10 248/518
7,201,442 B1 * 4/2007 Decosta, Jr. ..... A47C 7/66 135/16
8,291,923 B2 10/2012 Young et al.
9,447,600 B2 9/2016 Walker
(Continued)

*Primary Examiner* — Monica E Millner
(74) *Attorney, Agent, or Firm* — Boudwin Intellectual Property; Daniel Boudwin

(57) ABSTRACT

An improved umbrella holder. The improved umbrella member has a cylindrical member with an upper end and a bottom end. The upper end has a pair of arms extending from the rear surface of the cylindrical member to form a ring clamp. The ring clamp can be tightened to secure an umbrella inside of the cylindrical member. A slot is defined between the ring clamp and the cylindrical member to allow adjustment of the ring clamp independently from the cylindrical member.

9 Claims, 4 Drawing Sheets

(56) References Cited

U.S. PATENT DOCUMENTS

| | | | | |
|---|---|---|---|---|
| 9,493,962 | B2 | 11/2016 | Eddy | |
| 10,006,585 | B2 * | 6/2018 | Thomas | A45B 11/00 |
| 2007/0034758 | A1 * | 2/2007 | Bates | E04H 12/2276 248/218.4 |
| 2007/0108364 | A1 * | 5/2007 | Metheny | A45B 11/00 248/541 |
| 2012/0132779 | A1 | 5/2012 | Johnson et al. | |

* cited by examiner

UMBRELLA HOLDER

CROSS REFERENCE TO RELATED APPLICATIONS

This application claims the benefit of U.S. Provisional Application No. 62/659,418 filed on Apr. 18, 2018. The above identified patent application is herein incorporated by reference in its entirety to provide continuity of disclosure.

BACKGROUND OF THE INVENTION

The present invention relates to an improved umbrella holder. Umbrellas are commonly installed upon porches and patios to provide shade and comfort to users. One such method involves installing an umbrella through a centralized hole disposed through a patio table. This method, however, is not ideal as poor contact between the umbrella and the patio table can lead to instability. Instability of an umbrella installed in a patio table may lead to the umbrella tilting, rotating or collapsing.

Therefore, there exists a need in the known art for a device that is capable of securing an umbrella to an object apparatus while providing enhanced stability to the umbrella to prevent tilting, rotating or collapsing.

SUMMARY OF THE INVENTION

In view of the foregoing disadvantages inherent in the known types of umbrella holders now present n the known art, the present invention provides an improved umbrella holder wherein the same can be utilized for providing convenience for the s when suspending an umbrella over a desired location.

The present system comprises a cylindrical member. The cylindrical member has an upper end opposite of a lower end. Furthermore, the cylindrical member defines an interior cavity therein. A ring clamp is disposed at the upper end of the cylindrical member. The ring clamp is securing to the cylindrical member such that a slot is defined between the upper end of the cylindrical member and the ring clamp.

The ring clamp defines an opening wherein a first end is disposed opposite a second end. A hole is defined in each of the first end and the second end. The hole of the first end corresponds to the hole of the second end. A tightener is disposed through the hole of the first end and the hole of the second end.

In an additional embodiment, the improved umbrella holder further comprises a plurality of apertures linearly disposed upon a rear surface of the cylindrical member.

In a further embodiment, the improved umbrella holder further comprises a plurality of fasteners corresponding to the plurality of apertures such that the plurality of fasteners secures the improved umbrella holder to a vertically-extending object.

In another embodiment, the improved umbrella holder defines an opening at the bottom end of the cylindrical member.

In yet another embodiment, the improved umbrella holder defines a point at the bottom end of the cylindrical member.

In yet a further embodiment, the improved umbrella holder defines a protrusion from the ring clamp on each of the first end and the second end thereof.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
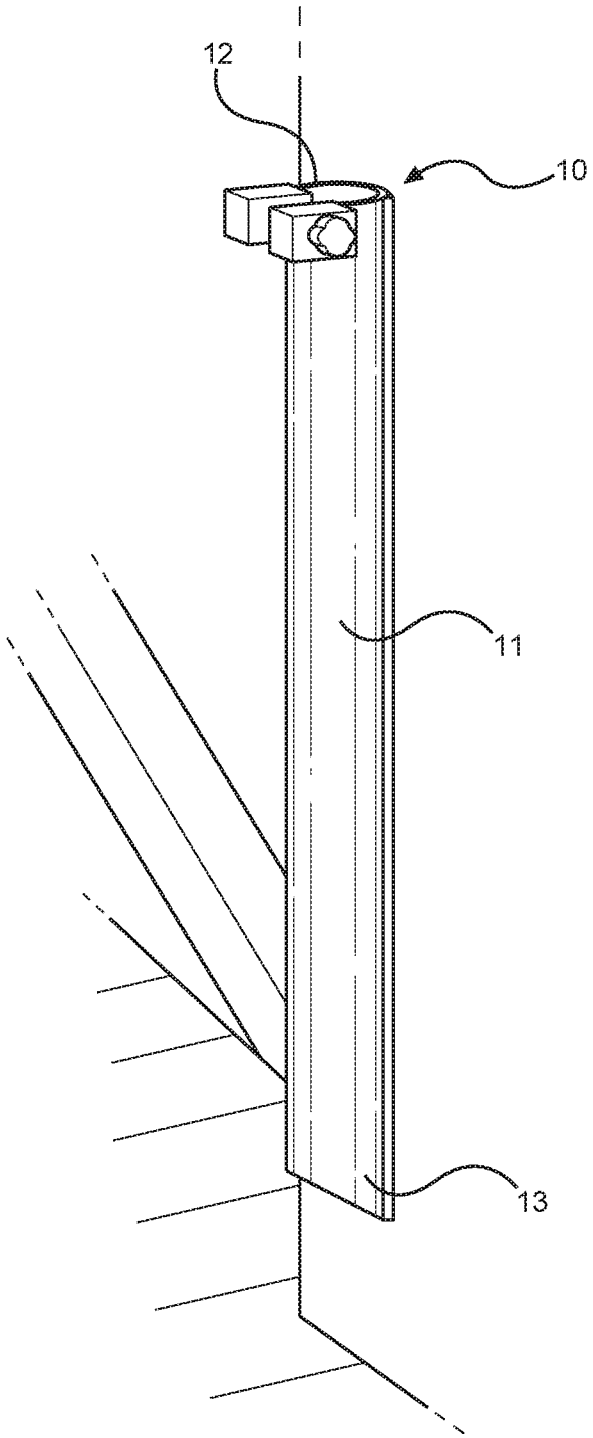
FIG. 1 shows a perspective view of an embodiment of the improved umbrella holder.

Reference is made herein to the attached drawings. Like reference numerals are used throughout the drawings to depict like or similar elements of the improved umbrella holder. The figures are intended for representative purposes only and should not be considered to be limiting in any respect.

Referring now to FIG. 1, there is shown a perspective view of an embodiment of the improved umbrella holder. The improved umbrella holder 10 comprises a cylindrical member 11. The cylindrical member 11 is made of a rigid material. Furthermore, the cylindrical member 11 is composed of a break-resistant material, such as to enable sufficient performance and enhanced protection during storms or winds.

The cylindrical member 11 defines an open upper end 12 disposed oppositely a bottom end 13. In the shown embodiment, the cylindrical member 11 is tubular. The tubular cylindrical member 11 defines an interior volume. The interior volume is dimensioned to receive a pole, such as an umbrella pole, therein. When used upon an umbrella pole, the umbrella will be suspended above a desired area at a desired height.

Figure 2A:
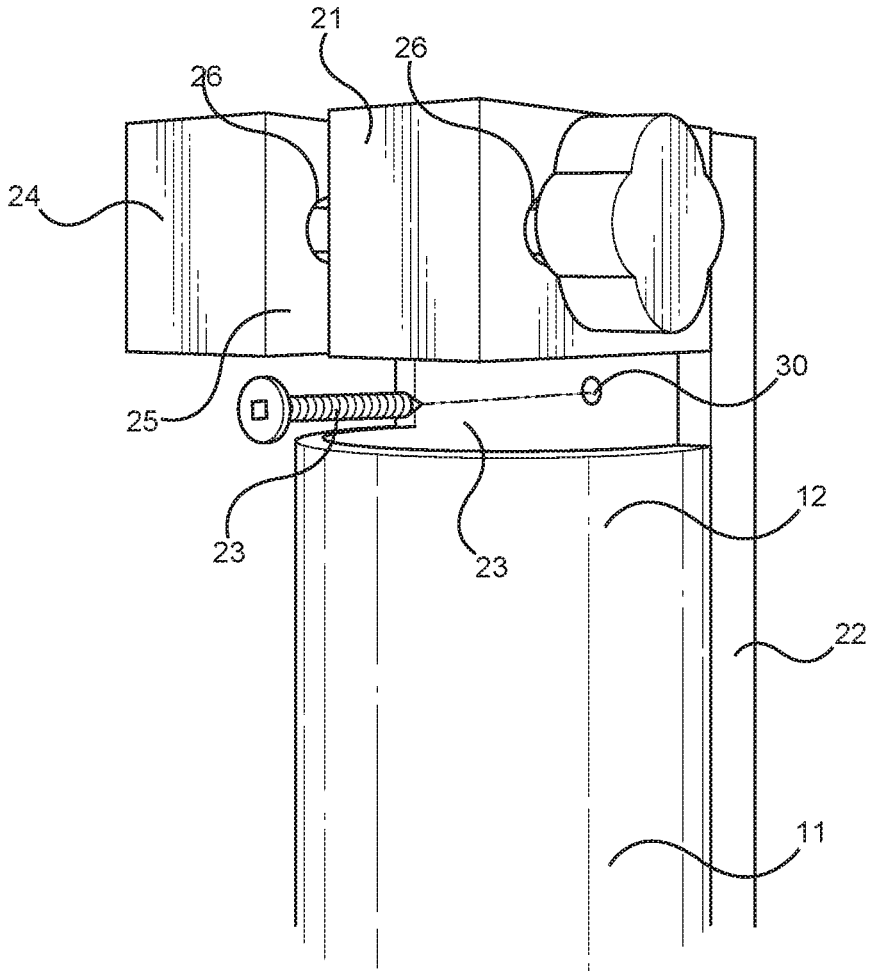
FIG. 2A shows a close-up view of an upper end of a cylindrical member of the improved umbrella holder.

Referring now to FIG. 2A, there is shown a close-up view of an upper end of the improved umbrella holder. The cylindrical member 11 comprises a ring clamp 21 at the upper end 12 of the cylindrical member 11. The ring clamp 21 is secured to the upper end 12 of the cylindrical member 11 at a rear surface thereof. In the shown embodiment, the rear surface defines a flat surface 22. The flat surface 22 provides convenience to a user when mounting the improved umbrella holder 10 upon a vertically-oriented structure.

The ring clamp 21 is secured to the upper end 12 of the cylindrical portion 11 at a rear surface thereof, such that a slot 23 is defined between the upper end 12 of the cylindrical member 11 and the ring clamp 21. The slot 23 is defined such that the circumference of the ring clamp 21 can be adjusted independently of the cylindrical member 11. Independent adjustability of the circumference of the ring clamp 21 allows for an umbrella to be securely held within the cylindrical member 11 without tension being exerted upon the entire cylindrical member 11.

The ring clamp 21 comprises a pair of arms 24 extending outwardly from the cylindrical member 11. An opening 25 is defined between the pair of arms 24. A hole 26 is defines in a central portion of each of the pair of arms 24. A first hole of the first arm corresponds to a second hole of the second arm.

In one embodiment, a plurality of apertures is disposed linearly upon a rear surface of the cylindrical member 11. As shown in FIG. 2, a first aperture 30 of the plurality of linearly disposed apertures is positioned such as to be accessible through the slot 23. In the shown embodiment, a fastener 31 is configured to extend through the first aperture 30 such as to secure the upper end 12 of the cylindrical member 11 to a vertical surface.

Figure 2B:
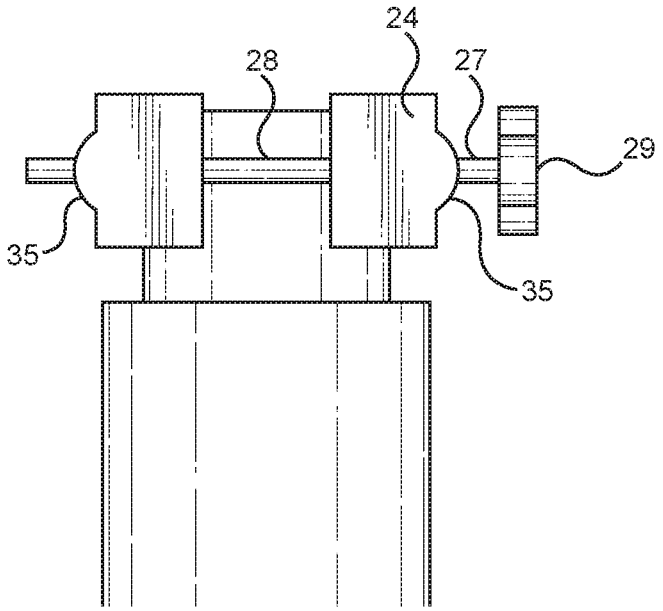
FIG. 2B shows FIG. 2B, a front view of the upper end of the improved umbrella holder.

Referring now to FIG. 2B, there is shown a front view of the upper end of the improved umbrella holder. A tightener 27 is disposed through the hole of each of the pair of arms 24. In the illustrated embodiment, the tightener 27 comprises a threaded rod 28 with a knob 29 disposed on an end thereof. In a further embodiment, a protrusion 35 is defined on each of the pair of arms 24 on the ring clamp 21. The protrusions 35 are configured to prevent overtightening of the ring clamp 21 around an umbrella. Overtightening of the ring clamp 21 around an umbrella pole may damage the umbrella that is stored in the improved umbrella holder 10.

Figure 3:
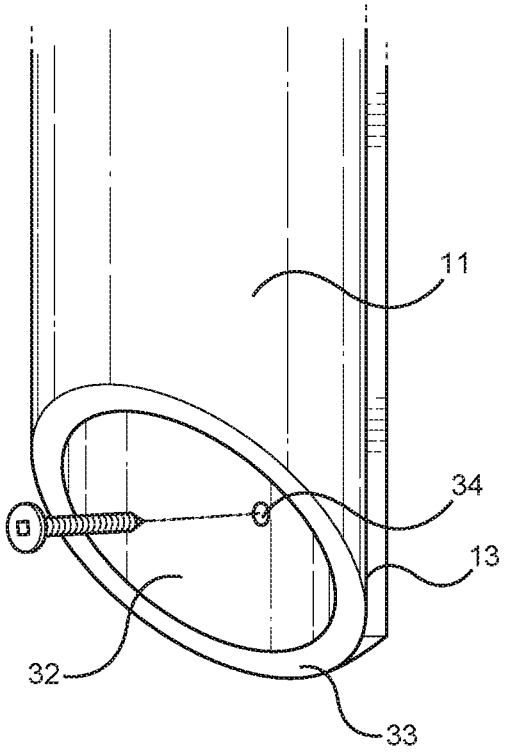
FIG. 3 shows a close-up view of a bottom end of a cylindrical member of the improved umbrella holder.

Referring now to FIG. 3, there is shown a close-up view of a bottom end of the improved umbrella holder. In the illustrated embodiment, the bottom end 13 of the cylindrical member 11 defines a drainage opening 32. The drainage opening 32 allows for the exit of fluids, such as rainwater, that enter the cylindrical member 11, as well as convenience when cleaning the improved umbrella holder.

Additionally, in another embodiment, the bottom end 13 of the cylindrical member 11 defines a pointed structure 33 extending downward therefrom. In the illustrated embodiment, the pointed structure is rounded, such as to avoid injuries associated with sharp objects. The pointed structure 33 allows for the improved umbrella holder to, among other objects, be placed into the ground.

Furthermore, the pointed structure 33 is oriented such that the rear surface of the cylindrical member 11 extends downward to a greater linear distance than a front surface of the cylindrical member 11. This greater linear extension allows access to a second aperture 34 of the plurality of apertures. The second aperture 34 is configured to secure the bottom end 13 of the cylindrical member 11 to a vertical surface, as the first aperture is configured to secure the upper end of the cylindrical member to the vertical surface.

Figure 4:
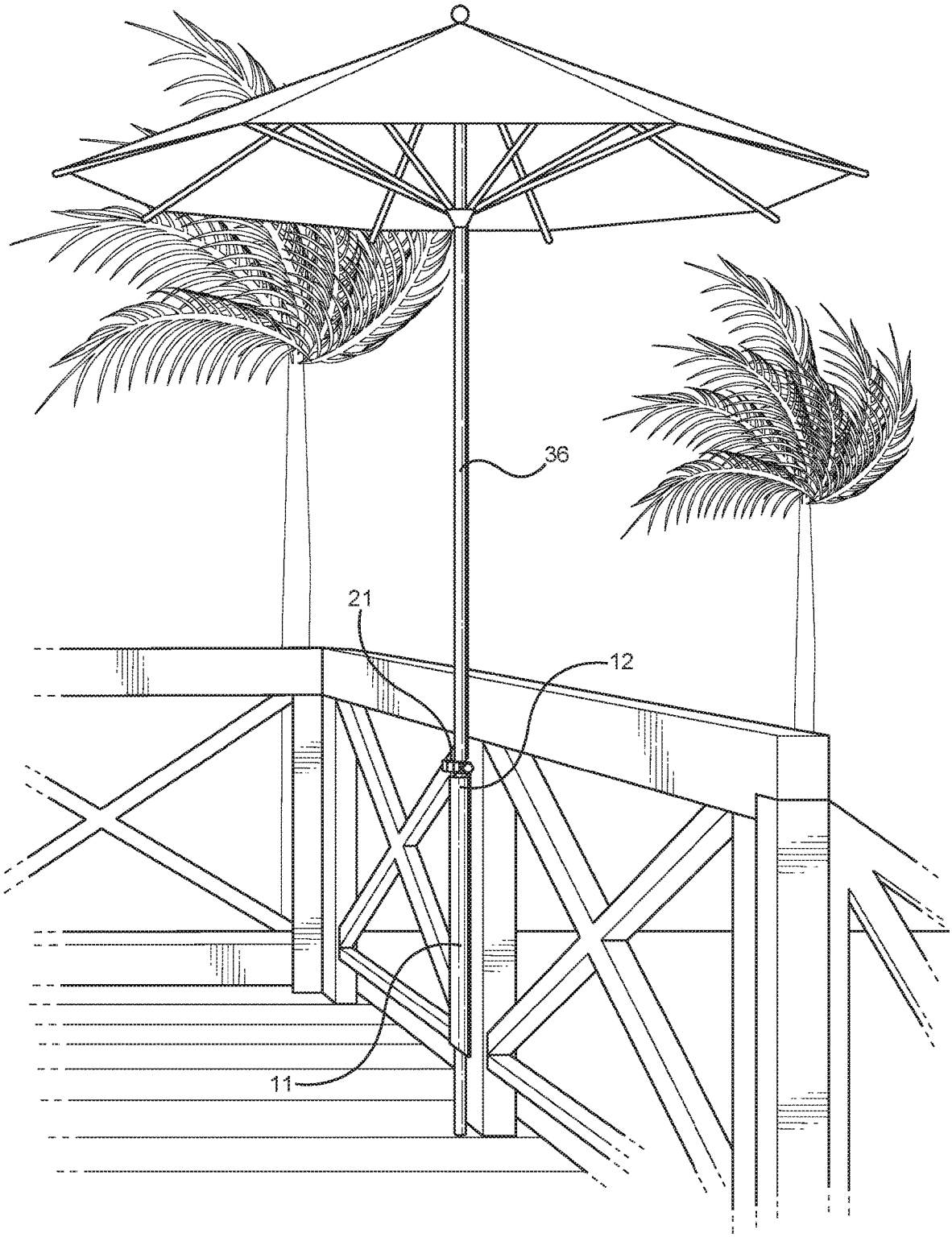
FIG. 4 shows a perspective view of an embodiment of the improved umbrella holder in use.

Referring now to FIG. 4, there is shown a perspective view of an embodiment of the improved umbrella holder in use. In use, the improved umbrella holder is secured to a stable structure. In the shown embodiment, the improved umbrella holder is secured to a vertical post of a deck rail. An umbrella 36 in inserted into the upper end 12 of the cylindrical member 11 of the improved umbrella holder. Once the umbrella 36 is set to a desired vertical relative to the cylindrical member 11, the tightener of the ring clamp 21 is engaged, such that the circumference of the ring clamp 21 is adjusted to amply secure the umbrella 36.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An improved umbrella holder, comprising:

a cylindrical member having an open upper end and a lower end;

the cylindrical member defining an interior cavity;

a ring clamp disposed at the upper end of the cylindrical member, the ring clamp comprising a pair of opposing arms extending from a rear surface of the cylindrical member;

the ring clamp secured to the upper end of the cylindrical member at the rear surface thereof, wherein a slot is defined between the upper end of the cylindrical member and the ring clamp;

the ring clamp defining an opening between the pair of arms, wherein each arm includes a hole;

wherein the hole of a first arm of the pair of arms corresponds to the hole of the second arm of the pair of arms;

a tightener disposed through the hole of the first arm and the hole of the second arm;

wherein the cylindrical member and the ring clamp are a single unitary piece.

2. The improved umbrella holder of claim 1, further comprising a plurality of apertures linearly disposed upon a rear surface of the cylindrical member in a linear arrangement.

3. The improved umbrella holder of claim 2, further comprising a plurality of fasteners corresponding to the plurality of apertures, such that the plurality of fasteners removably secure the improved umbrella holder to a vertically-extending object.

4. The improved umbrella holder of claim 1, wherein a bottom end of the cylindrical member defines an opening.

5. The improved umbrella holder of claim 1, wherein the bottom end of the cylindrical member defines a pointed structure.

6. The improved umbrella holder of claim 1, wherein the ring clamp defines a protrusion from the ring clamp around each of the hole of the first arm and the hole of the second arm.

7. The improved umbrella holder of claim 1, wherein the cylindrical member enclosed the interior cavity through the entire length of the cylindrical member.

8. The improved umbrella holder of claim 1, wherein the opening extends entirely through each of the pair of arms of the ring clamp.

9. The improved umbrella holder of claim 1, wherein a drainage opening is defined at the bottom end of the cylindrical member, the drainage opening extending across the entirety of the lower end of the cylindrical member.

* * * * *